US008631834B2

(12) United States Patent
Yang

(10) Patent No.: US 8,631,834 B2
(45) **Date of Patent: *Jan. 21, 2014**

(54) SPIN IMPROVEMENT STRING TOOL

(76) Inventor: Luyu Yang, Tyngsborough, MA (US)

( * ) Notice: Subject to any disclaimer, the term of this patent is extended or adjusted under 35 U.S.C. 154(b) by 202 days.

This patent is subject to a terminal disclaimer.

(21) Appl. No.: 13/355,512

(22) Filed: Jan. 21, 2012

(65) Prior Publication Data

US 2012/0115654 A1 May 10, 2012

Related U.S. Application Data

(63) Continuation of application No. 12/833,981, filed on Jul. 10, 2010.

(51) Int. Cl.
*B21F 9/00* (2006.01)
*B25B 7/02* (2006.01)

(52) U.S. Cl.
USPC ..... 140/123; 140/123.5; 81/418

(58) Field of Classification Search
USPC ..... 140/106, 123, 123.5, 105; 72/409.01–409.19, 479; 81/415, 418, 81/424.5, 426, 426.5; 473/543
See application file for complete search history.

(56) References Cited

U.S. PATENT DOCUMENTS

| | | | | | |
|---|---|---|---|---|---|
| 371,639 | A | * | 10/1887 | Taylor | 227/144 |
| 685,215 | A | * | 10/1901 | Magui | 81/342 |
| 2,716,365 | A | * | 8/1955 | Keeley, Jr. | 81/416 |
| 2,934,983 | A | * | 5/1960 | Daggitt | 72/409.01 |
| 2,990,863 | A | * | 7/1961 | Pantermoller | 81/418 |
| 3,626,995 | A | * | 12/1971 | Keenan, Jr. | 140/106 |
| 5,084,935 | A | * | 2/1992 | Kalthoff | 72/409.01 |
| 5,165,155 | A | * | 11/1992 | Adams | 29/268 |
| 6,257,101 | B1 | * | 7/2001 | Marlette et al. | 81/165 |
| 6,386,077 | B1 | * | 5/2002 | Hartman | 81/426 |
| 7,114,414 | B1 | * | 10/2006 | Peck | 81/3.6 |
| 7,124,786 | B1 | * | 10/2006 | Gowhari | 140/118 |
| 8,052,420 | B2 | * | 11/2011 | Navarro | 433/4 |
| 2005/0051000 | A1 | * | 3/2005 | McIlvenna et al. | 81/44 |

* cited by examiner

*Primary Examiner* — Shelley Self
*Assistant Examiner* — Pradeep C Battula

(57) ABSTRACT

The spin improvement string pliers is a pivotally secured together plier device used to manually restructure and roughen the surface of a synthetic or a polyester string on a strung tennis racquet by means of plastic deformation. The line grids on the pliers depress the string, leaving a series of indentations on the string surface that increases the friction between the string and the ball so that the tennis player can more easily generate top or under spin on a tennis ball.

8 Claims, 3 Drawing Sheets

SPIN IMPROVEMENT STRING TOOL

This application is a continuation of application Ser. No. 12/833,981 filed on Jul. 10, 2010.

FIELD OF INVENTION

The present invention relates to a pivotally secured together plier device used to manually restructure and roughen the surface of polyester and synthetic gut tennis strings on a strung tennis racquet. The roughened string surface increases the friction between the string and the tennis ball and thus the player can more easily generate spin on a tennis ball while striking the ball.

BACKGROUND OF THE INVENTION

Many tennis players try many different techniques to generate spin when they hit the tennis balls. With an ultra-high-speed, 10,000-frame-per-second camera, we can now clearly see how strings generate spin during the 4 or 5 milliseconds when the ball is on the strings. Most spin is generated by main strings (vertical strings) slide and snap back movement after they contact with the tennis ball. Thus, the rougher the main string surface is, the more main string slide and snap back with more power for spin generation, and the easier it is for the player to generate spin. Basically, in order to generate more spin, we need two factors: 1. a rough string/ball contact surface, therefore the strings can grasp the ball better, and the ball can push the main strings to slide more over the cross strings(cross strings); as a result, the main strings can generate more spin when they snap back. 2. a smooth main string/cross string contact surface, therefore the main strings can slide farther over the cross strings and snap back efficiently because of less frictions between the strings, this will give an extra kick to the ball and generate more spin. In order to satisfy two factors stated above, you need a main string that has two different surfaces, rough on the top (where it contacts with the ball) and smooth on the bottom (where it contacts with the cross string) in order to generate spin efficiently.

Most strings are made of synthetic nylon and polyester, and some of them are made of natural gut. Some string manufacturers provide Octagon or Hexagon shaped polyester strings to increase the friction between the string and ball. It may be effective on the main strings when they are new, after some time, the sharp edge of the Octagon and Hexagon will be worn away by wear and tear between the string and ball. As a result, the main strings can no longer grasp and generate spin as effective as when they are new. Some strings come with a series of small dents on the surface to increase the roughness of the string surface. This is effective when it is new, however, after some time, the small dents will be worn off and the string surface becomes smooth again.

BRIEF SUMMARY OF THE INVENTION

The primary objective of this invention is to provide a plier device to mechanically and permanently restructure and roughen the surface of a tennis racquet string, section by section on a strung tennis racquet, by means of mechanical deformation on a string to make friction marks. As a result of this process, the friction between the string and ball will be increased, while the friction between the strings will remain the same. This will allow the main strings slide further over the cross strings, and snap back with more power for spin generation.

In accordance with the present invention, there is provided a plier device comprising a pair of handle levers including a middle portion pivotally secured together with a pivot shaft. Each lever has a handle on one end and a jaw on the other. The plier device is made of steel or another hard material. Only upper jaw has an elevated pattern of closely adjacent line grids or other shapes, such as diamond. They make friction marks on the strings. The lower jaw is smooth and does not make any friction marks on the strings. The end of the lower jaw has an "L" shaped string locker design with a slot in the middle, which allows the bottom jaw to slide beneath a string by rotating the plier handles. On the bottom of bottom jaw, there is also a slot in the middle. This slot allows the lower jaw to be inserted easily between the main and cross tennis strings. Once the upper jaw is above the string and bottom jaw is beneath the string, close the pliers. A series of elevated line grids will then press and reform the string surface and leave a series of indentations on the string without damaging other characteristics of the string. The roughened string surface increases friction between the string and ball, making it easier for the players to generate spin. After some time, if the indentations on the string are worn because of wear and tear, the pliers can be used again to roughen the string. On the upper jaw, there is an adjustment screw and it can be used to adjust the distance of the gap between the upper and bottom jaws, according to various sizes of string diameters. This device solves two common problems for tennis players: 1. Smooth polyester round strings are slippery, they allow the main string to slide and snap back efficiently for spin generation. However, the smooth round strings cannot grasp the ball well. With this device, the string surfaces where they contact the ball can be roughened, and the strings faces between the strings are kept smooth, therefore strings can grasp the ball better for spin generation. 2. Textured/shaped strings can grasp the ball much better than smooth strings, but they become smooth very quickly and no longer effective in spin generation. They are usually cut and replaced before they break. With this device, the string surface can be roughened again, therefore the string performance can be revived.

DETAILED DESCRIPTION OF THE INVENTION

Figure 1:
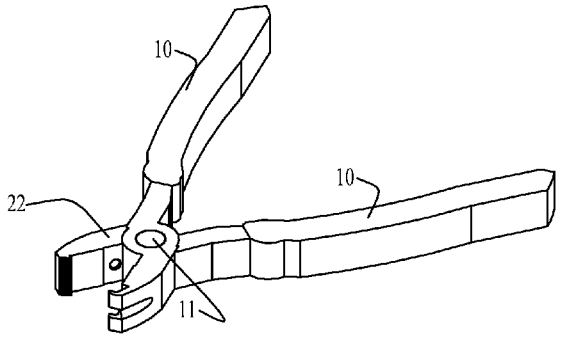
FIG. 1 is an exploded view of the string pliers in accordance with the present invention.
Figure 2:
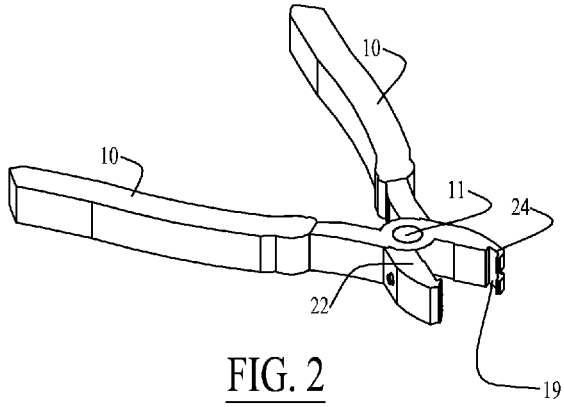
FIG. 2 is another exploded view of the string pliers in accordance with the present invention.
Figure 3:
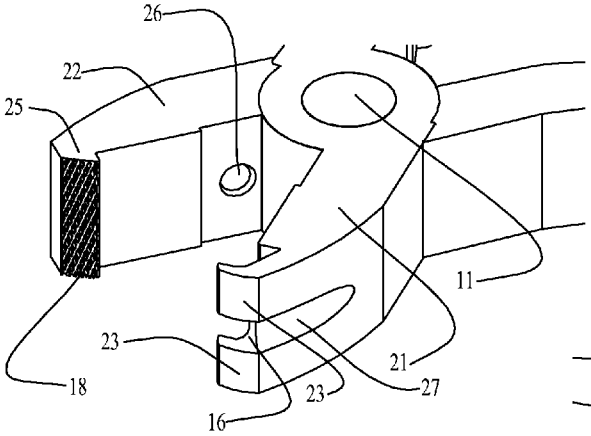
FIG. 3 is a close up exploded view of the upper jaw when the pliers are open.

Referring to FIG. 1, FIG. 2 and FIG. 3, the tool of the present invention can be seen to include two plier handles

Figure 4:
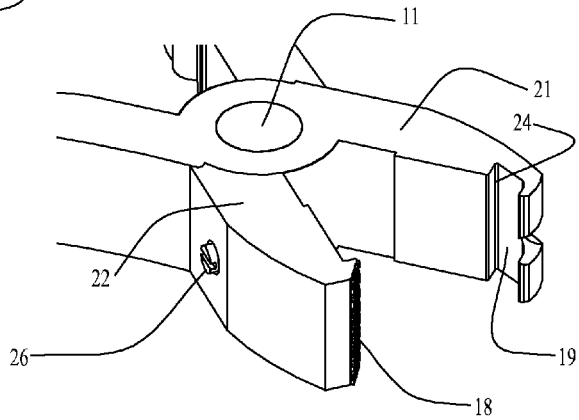
FIG. 4 is a close up exploded view of the bottom jaw when the pliers are open.
Figure 5:
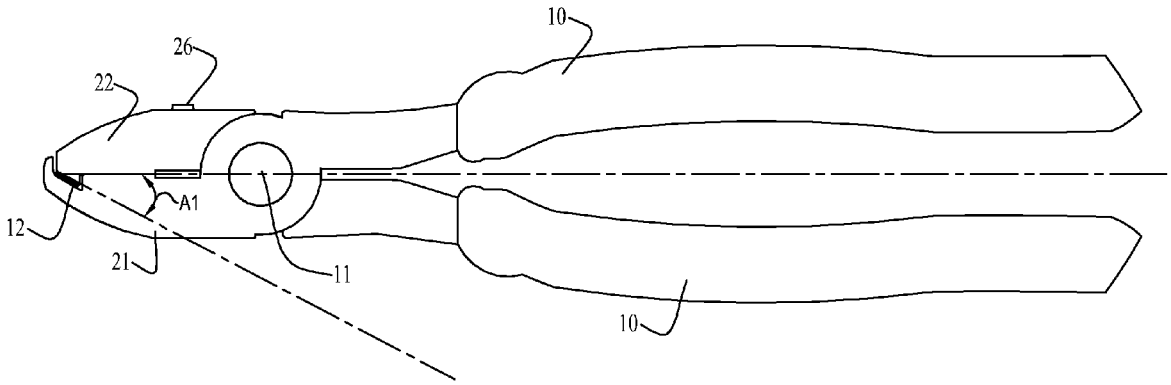
FIG. 5 is a front view of the string pliers when they are closed.

10-10 which pivot about pivot pin 11. One of the handles 10-10 is rigidly connected to upper jaw 22 and the other handle is rigidly connected to lower jaw 21. When handles 10-10 are spread apart, the jaws open, as shown in FIG. 1, FIG. 2, FIG. 3 and FIG. 4, and when the handles 10-10 are closed, the jaws close, as indicated in FIG. 5. Upper jaw 22 contains an elevated pattern of adjacent diamond shaped line grids 18, as indicated in FIG. 3. The line grids 18 can come with different shapes, a rectangular block, a pyramid, a triangle, diamond, cylinder or a half cylinder. Lower jaw 21 surface 19 is smooth, as indicated in FIG. 4.

The upper jaw 22 and lower jaw 21 are shown in greater detail in FIG. 3 and FIG. 4. The upper jaw 22 has an elevated L shaped jaw tip 25 at the end. An elevated pattern of elements 18 is on the top of elevated L shaped jaw tip 25. Right beneath the elevated L shaped jaw tip 25 on the upper jaw 22, a recessed indentation 24 is located on the lower jaw 21. The indentation 24 is about ⅛"-½" wide and 3/16" to 5/16" deep. The top of the recessed indentation 24 is smooth, as indicated in FIG. 4. The recessed indentation 24 is to lock the string in place once the lower jaw 21 slides beneath the string. Upon closure of the upper jaw 22 and the lower jaw 21, a gap 12 is formed between the upper jaw 22 and the lower jaw 21, as indicated in FIG. 5. The formed gap 12 is about 1/32" which prevents the string from being overly deformed by the upper jaw 22 and lower jaw 21 respectively. Adjustment screw 26 can be used to adjust the distance of gap 12 between upper jaw 22 and lower jaw 21.

The lower jaw 21 has 2 elevated L shaped string lockers 23 at the end, which are extruded from upper jaw 22, as indicated on FIG. 3 and FIG. 4. Between these two L shaped string lockers 23, at the end of lower jaw 21, a slot 16 about ⅛" in width and ½" in depth is located in the center. A polished slot 27 on the bottom of lower jaw 21 allows the lower jaw 21 to be easily inserted between tennis strings 14 and 15, and allows lower jaw 21 to be easily pivoted about the string 14 and push down string 15 after lower jaw 21 is inserted under string 14.

In FIG. 5, it can be seen that the surfaces of upper jaw 22 and lower jaw 21 are not parallel to the center line of the handles 10 of the pliers. Instead, it forms an angle A1. This feature makes the tool of the present invention much easier to operate than if it had the surfaces of upper jaw 22 and lower jaw 21 in direct alignment with the center line of the plier handles 10. Angle A1 indicated in FIG. 5 may vary from about 20° to about 35°, or more preferably from about 25° to 30°.

Figure 6:
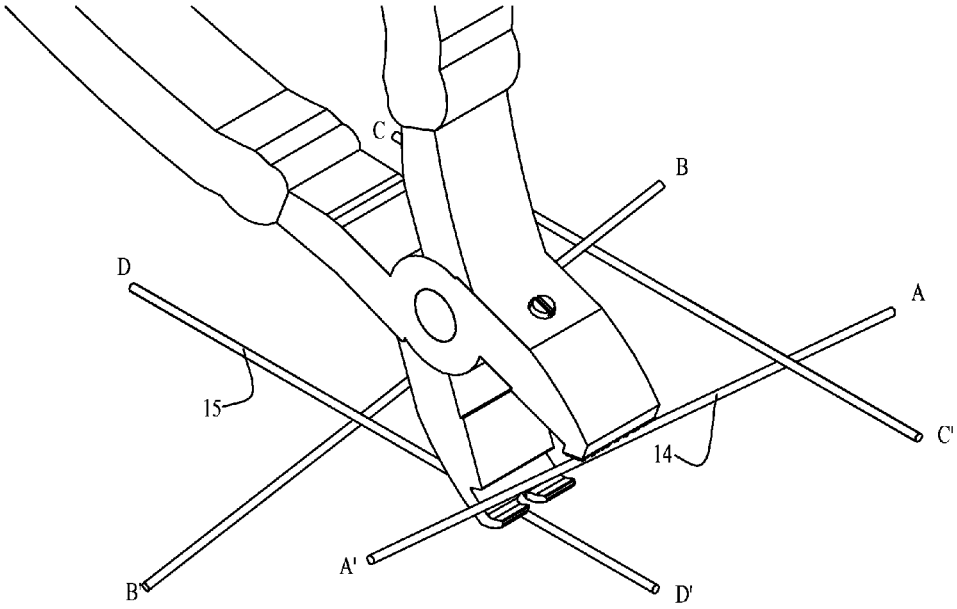
FIG. 6 is an exploded view of how to use the string pliers on a strung racquet.
Figure 7:
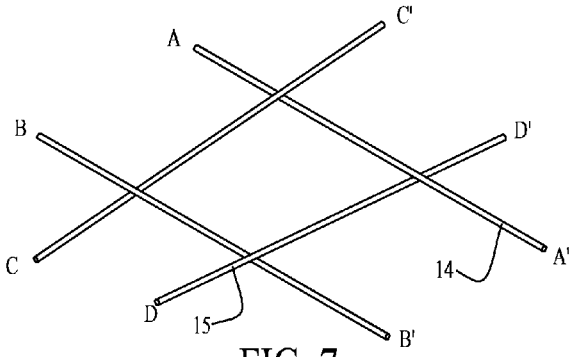
FIG. 7 is a close up front view of the tennis strings before string pliers are used.
Figure 8:
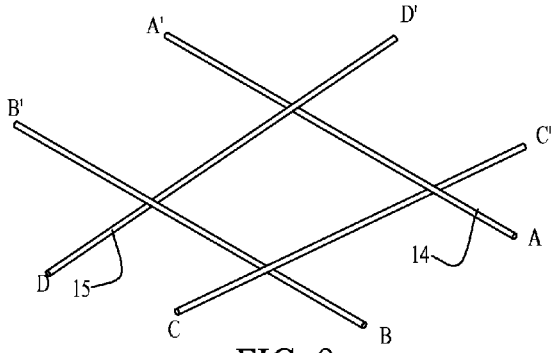
FIG. 8 is a close up back view of string before string pliers are used after the string bed is flipped over.
Figure 9:
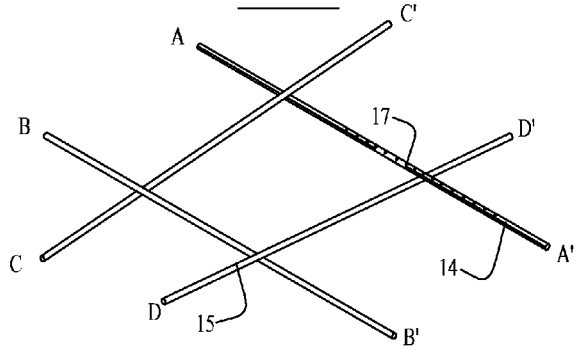
FIG. 9 is a close up front view of string after string pliers are used.
Figure 10:
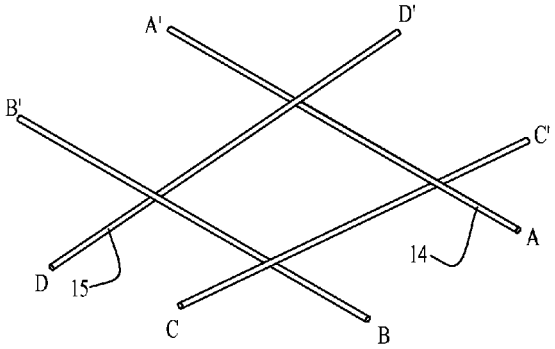
FIG. 10 is a close up back view of string after string pliers are used after the string bed is flipped over.

The manner in which the tool of the present invention is used to deform and roughen the surface of the string on a strung racquet is shown in FIG. 6-10. In FIG. 6, the player intends to make a series of indentations on a main string 14 on a strung racquet. The player first puts the elevated L shaped string lockers 23 located at the end of lower jaw 21 under the cross string 14, while the main string 15 is inserted in the slot 16 located in the center of lower jaw 21. The L shaped string lockers 23 and the slot 16 lock both the cross string 15 and the main string 14 in place. The player then pushes down the plier handles 10, so the plier pivots about the main string 14, As a result, the cross string 15 is pushed down by the slot 16 and slot 27, and the lower jaw 21 is pushed under the main string 14. Main string 14 is then pushed on the recessed indentation 24 on lower jaw 21, and indentation 24 locks the main string 14 in place. Finally, the player can close the pliers and leave a series of indentations on the main string 14, as indicated in FIG. 9. FIG. 7 and FIG. 8 show the front and the back of main string 14 before the pliers are used. FIG. 9 and FIG. 10 show the front and the back of main string 14 after the pliers are used to depress the main string 14. FIGS. 9 and 10 also show that a series of indentation is only put on the upper surface of main string 14, but not on the bottom surface of main string 14. This process increases only the friction between main string 14 and tennis ball, but does not change the friction between main string 14 and cross string 15, therefore main string 14 can slide and snap back over the cross string 15 efficiently for spin generation. After the string is pressed, the pliers can then be opened and rotated upward to release the main string 14 and cross string 15.

The same manner can be repeated to put a series of indentations on the rest of the main string 14. The player needs to turn over the racquet and work on the other side of the racquet to complete roughening the string surface. It is not necessary to roughen all the strings on the racquet, it is sufficient to roughen the string in the "sweet spot" on the main strings only, where the string makes contact with the balls most often. This covers about ⅓ the racquet area, in the center. The players can repeat the same process to roughen the cross string 15. Roughening cross string 15 will allow cross string 15 grasp tennis ball better, however, it also increase the friction between main string 14 and cross string 15 and prevent main string 14 from sliding and snapping back efficiently over the cross string 15.

The tool of the present invention is made from any suitable common metal such as steel alloy, aluminum alloy, plastic with high hardness and the like. The handles 10-10 of the tool may preferably be covered with soft material such as plastic or rubber, or the like.

Although a preferred embodiment of the invention has been disclosed for the purpose of illustration, it will be understood that various changes, modifications, and substitutions may be incorporated in such embodiment within the scope of the invention without departing from the spirit of this invention.

What is claimed is:

1. A hand tool used for restructuring the surface of a polyester and synthetic strings on a strung tennis racquet by means of mechanically applied deformations of the material is comprised of: a pair of upper and lower jaws rigidly connected to handles, said upper and said lower jaw being pivotally connected for movement about a pivot axis in a scissor relation, said upper jaw comprises first end and second end, said upper jaw first end comprises an elongated L shaped jaw tip located at the end of said upper jaw first end, an elevated pattern of line grids located on the surface of said elongated jaw tip, an adjustment screw located at the center of said upper jaw; said lower jaw comprises first end and second end, said lower jaw first end comprises two L shaped string lockers, a slot between said two L shaped string lockers, a recessed indentation, located at the second end of said lower jaw first end, the top surface of said recessed indentation is smooth, said lower jaw comprises a slot located on the bottom and at the center of said lower jaw, on an exterior surface; said upper jaw and said lower jaw each having a surface forming an angle with the center line of the handles of said tool, which varies from 20° to 35° .

2. The tool of claim 1 wherein said line grids located on the surface of said elongated jaw tip comprise at least a block, a pyramid, a triangle, diamond, cylinder or a half cylinder.

3. The tool of claim 1 wherein said two L shaped string lockers located at the end of said lower jaw are extruded from said upper jaw, said two L shaped string lockers lock a string in place and allow said lower jaw and said upper jaw to pivot about said string.

4. The tool of claim 1 wherein said recessed indentation on the top surface of said lower jaw is about ⅛"-½" wide and 3/16" to 5/16" deep, the top surface of said indentation in said lower jaw is smooth and has no grid lines.

5. The tool of claim 1 wherein said lower jaws and said upper jaw have an about 1/32" gap between a top surface of line grids connected to said upper jaw and a top surface of said lower jaw, upon closure of said upper jaw and said lower jaw.

6. The tool of claim 1 wherein said adjustment screw adjusts the distance of a gap between said upper jaw and said lower jaw.

7. The tool of claim 1 wherein said slot between said two L shaped string lockers of said lower jaw pushes down a cross or a main string and separates said cross string from a main string, and allows said lower jaw to be inserted between a cross string and said main string on said strung racquet, said slot is about 1/8" in width and 1/4" to 3/16" in depth from the end of said lower jaw.

8. The tool of claim 1 wherein said slot minimizes gaps between cross and main strings and allows said lower jaw to be easily inserted between said cross and main strings, said slot is about 1/4" wide and 1" long.

* * * * *